US007448803B2

(12) United States Patent
Ootsubo

(10) Patent No.: US 7,448,803 B2
(45) Date of Patent: Nov. 11, 2008

(54) PROCESS FOR PRODUCING COMPRESSION BAG AND COMPRESSION BAG

(75) Inventor: Ryouichi Ootsubo, Sakurai (JP)

(73) Assignee: Mikio Tanaka, Nara (JP)

( * ) Notice: Subject to any disclaimer, the term of this patent is extended or adjusted under 35 U.S.C. 154(b) by 557 days.

(21) Appl. No.: 10/496,678

(22) PCT Filed: Feb. 5, 2004

(86) PCT No.: PCT/JP2004/001212

§ 371 (c)(1),
(2), (4) Date: May 26, 2004

(87) PCT Pub. No.: WO2005/066031

PCT Pub. Date: Jul. 21, 2005

(65) Prior Publication Data

US 2005/0252816 A1 Nov. 17, 2005

(30) Foreign Application Priority Data

Jan. 10, 2004 (JP) ..... 2004-034225

(51) Int. Cl.
*B65D 33/01* (2006.01)

(52) U.S. Cl. ..... 383/100; 383/101; 383/44

(58) Field of Classification Search ..... 383/100, 383/101, 44; 206/524.8
See application file for complete search history.

(56) References Cited

U.S. PATENT DOCUMENTS

| | | | | |
|---|---|---|---|---|
| 5,540,500 | A * | 7/1996 | Tanaka | 383/43 |
| 5,701,996 | A * | 12/1997 | Goto et al. | 206/287 |
| 6,116,781 | A * | 9/2000 | Skeens | 383/100 |
| 2002/0044702 | A1 | 4/2002 | Koyanagi | |

FOREIGN PATENT DOCUMENTS

| | | | |
|---|---|---|---|
| JP | 8-230898 | A | 9/1996 |
| JP | 9-309544 | A | 12/1997 |
| JP | 2002-114236 | A | 4/2002 |
| JP | 2002-302164 | A | 10/2002 |

* cited by examiner

*Primary Examiner*—Nathan J Newhouse
*Assistant Examiner*—Jack H Morgan, Jr.
(74) *Attorney, Agent, or Firm*—Birch, Stewart, Kolasch & Birch, LLP

(57) ABSTRACT

A compression bag includes longitudinally continuous sheets continuously supplied in a longitudinal direction to lie one upon another, and adhered at predetermined spots to form an article containing portion having a space for an article and an air passageway having a space continuing to the space of the article containing portion. The sheets include a frontal sheet, a rear sheet which is equal to the frontal sheet in breadth (i.e., the transverse side dimension of the sheets), at least one valve body sheet disposed between the frontal and rear sheets and made smaller than the front and rear sheets in breadth, and base members disposed between at least one of the frontal and rear sheets and the valve body sheet and made smaller than the valve body sheet in breadth.

13 Claims, 12 Drawing Sheets

PROCESS FOR PRODUCING COMPRESSION BAG AND COMPRESSION BAG

TECHNICAL FIELD

The present invention relates to a compression bag which contains an article and is then evacuated thereinside.

BACKGROUND ART

Compression bags 101, 201 having an article containing portion 102, 202 enveloped by flexible resin sheets as joined together by heat-sealing or the like at their predetermined spots have been widely used.

An opening 103, 203 through which the article M is inserted or removed from the article containing portions 102, 202 is provided in said compression bags 101, 201. Also, a closing means 104, 204 such as a fastener for keeping the openings 103, 203 closed is provided in the opening 103, 203.

Though various embodiments of such compression bags exist, roughly speaking, two types of compression bags 101, 201 described below exist.

First, it is disclosed by Japan Laid-open Patent Application No. 9-309544. Simply illustrated in FIG. 11, a compression bag 101 includes a check valve 105. A check valve 105 used in the compression bag 101 comprises an outer tubular portion 107 of a flexible resin sheet which is formed into a flat tube so as to connect a space of the article containing portion 102 with the outside of the compression bag 101, and a valve body sheet 106 made of a flexible resin sheet provided inside the outer tubular portion 107 as shown in FIG. 11(B).

Since said valve body sheet 106 functions to permit an air-flow F1 from the article containing portion 102 to the outside of the compression bag 101 and to block the reverse air-flow F2, an evacuated condition in the article containing portion 102 can be maintained by the check valve 105 after evacuation.

Having contained the article M in the article containing portion 102 and closed by the closing means 104, said compression bag 101 can maintain an evacuated condition after discharging the air in the article containing portion 102 through the check valve 105.

This structure is particularly effective for a voluminous article M like clothing and blanket, and the air in the article M can be discharged outside the compression bag 101, which can make compact while containing the article M. Thus, the compression bag 101 is suitable for a preservation bag for clothes or a bag used during travel.

The check valve 105, however, is manufactured separate from the bag sheets 102*a*, 102*b* constituting the article containing portion 102, and is incorporated into the article containing portion 102 later when the article containing portion 102 is formed afterward, whereby each production step of manufacturing the check valve 105 and incorporating it into the article containing portion 102 is required. This may complicate the production steps for the compression bag 101, and a special production system must be employed for this purpose, thus resulting in increase of the production costs.

Also, when the check valve 105 is incorporated in the compression bag 101 as described above, heat-seal 108 is provided as shown in FIG. 11(B), and the bag sheets 102*a*, 102*b* constituting the article containing portion 102 and the outer tubular portion 107 of the check valve 105 are bonded. Said heat-seal 108 is formed on the bag sheets 102*a*, 102*b* where the check valve 105 slips therebetween by pressing of a heated mold from outside the bag sheets 102*a*, 102*b* in a manner of crossing the check valve 105.

Accordingly, in order not to bond the outer tubular portion 107 of the check valve 105 and the valve body sheet 106 together against heat-sealing, a coating material 106*b*, for example, for preventing the face 106*a* from melting by heat during the heat-sealing is applied to the face 106*a* of the valve body sheet 106 opposite to the inner face of the outer tubular portion 107. But, even though the coating material 106*b* is applied, the inner side of the outer tubular portion 107 where the coating material 106*b* is not applied may melt under thermal influence of the heat-sealing, resulting in a slightly heat-sealed condition (a slight heat-seal 109) between the outer tubular portion 107 and the valve body sheet 106. Although the slight heat-seal 109 is actually not so strong against an external force, the internal pressure of the article containing portion 102 may increase in the initial use of the compression bag 101, from separation of the outer tubular portion 107 and the valve body sheet 106 caused by detachment of the slight heat-seal 109 till opening of the check valve 105, entailing resistance in evacuation, requiring much time to complete the evacuation. In a certain case, the drawback leads to a risk of burst of the bag sheets 102*a*, 102*b* of the article containing portion 102. Such a disadvantage is particular in a manual evacuation of the article containing portion 102.

Another embodiment of the compression bag 201 is disclosed by U.S. Pat. No. 6,116,781, as shown in FIG. 12. In this particular compression bag 201, an intermediate sheet 206 is disposed between the two opposite bag sheets 202*a*, 202*b* so as to make an air passage therebetween, forming a check valve 205. Said check valve 205 can achieve a non-return function by a tight contact of the bag sheets 202*a*, 202*b* and the intermediate sheet 206.

Unlike the above-described compression bag 101, since a check valve 205 in the compression bag 201 is integrally formed from the beginning, it is an advantage that only one single production step is required in the production process. Additionally, a problem of forming a slight heat-seal 109 taking place when a separate check valve 105 as described above is incorporated will not occur.

The intermediate sheet 206 in this compression bag 201, however, is simply disposed between the bag sheets 202*a*, 202*b*, the arrangement of which does not achieve a complete non-return function, whereby it is impossible to maintain a secure evacuation of the article containing portion 202.

In view of these problems, the object of the present invention is to provide a production method for a compression bag and the compression bag, wherein the compression bag may be produced in a single production step which leads to reducing production costs, being able to maintain a secure evacuation of the article containing portion and easily evacuate against low pressure resistance even in a manual evacuation.

DISCLOSURE OF THE INVENTION

In order to overcome the problems described above, a first aspect of the present invention as defined in claim 1 provides a production method for a compression bag 1 wherein a plurality of longitudinal continuous components 11, 12, 31, 32 of flexible resin sheet or the like are continuously supplied in a longitudinal direction to lie one upon another and then bonded at predetermined positions so as to form an article containing portion 2 having a space for containing an article and an air passageway 3 having a space continuing to the space of the article containing portion 2, characterized in that said components comprise a frontal sheet 11; a rear sheet 12 which is equal to the frontal sheet 11 in breadth dimension being a transverse side dimension of the sheets; at least one valve body sheet 31 disposed between said sheets 11, 12 and made smaller than both sheets 11, 12 in breadth dimension; and a base member 32 disposed between the valve body sheet 31 and at least one of the frontal sheet 11 and the rear sheet 12 and made smaller than the valve body sheet 31 in breadth dimension, and the process comprises a step of placing the valve body sheet 31 and the base member 32 laid thereon between the frontal sheet 11 and the rear sheet 12; and a step of bonding said disposed components 11, 12, 31, 32 at predetermined positions, and side seals 33, S42 acting as a sidewall of the air passageway 3 are formed in the step of bonding said components 11, 12, 31, 32 in respect of forming the air passageway 3.

A second aspect of the present invention as defined in claim 2 provides the production method for a compression bag as defined in claim 1, characterized in that said components 11, 12, 31, 32 are composed of a plurality of laminated resin films, and that said valve body 31 is at least part of either the frontal sheet 11 or the rear sheet 12, and has been formed as at least one of the resin films that constitute said frontal sheet 11 and rear sheet 12, and remain unbonded in a certain adjacent area therebetween.

A third aspect of the present invention as defined in claim 3 provides the production method for a compression bag as defined in claim 1, characterized in that said base member 32 consists of a thread-like material.

A fourth aspect of the present invention as defined in claim 4 provides production method for a compression bag as defined in claim 1, characterized in that bonding of said components 11, 12, 31, 32 is done by heat-sealing of pressing a heated mold against said components, and the heat-seal as formed by said heated mold is not provided in the position where said air passageway 3 is formed.

A fifth aspect of the present invention as defined in claim 5 provides a compression bag wherein components such as a plurality of flexible resin sheets 11, 12, 31, 32 or the like are laid one upon another and then bonded at predetermined positions so as to form an article containing portion 2 having a space for an article and an air passageway 3 having a space continuing to the space of the article containing portion 2, characterized in that said compression bag 1 comprises a frontal sheet 11; a rear sheet 12 disposed opposite to the frontal sheet 11; at least one valve body sheet 31 disposed between said both sheets 11, 12, the valve body sheet having a part adhered to the frontal sheet 11 or the rear sheet 12 and the rest part except for the bonded part being arranged to move to or away from the frontal sheet 11 or the rear sheet 12; and a base member 32 disposed between the valve body sheet 31 and at least one of the frontal sheet 11 and the rear sheet 12, and the air passageway 3 is defined by two side seals 33 formed by bonding said sheets 11, 12, 31, 32 in a direction from the article containing portion 2 to the outside of the compression bag 1, and the valve body sheet 31 acts to block an air-flow passing through the air passageway 3 by a contact part 31*a* which is on the reverse side of the area adhered to either said frontal sheet 11 or rear sheet 12 to contact any one of the frontal sheet 11, rear sheet 12, and valve body sheet 31 disposed opposite to the contact part 31*a*, and the base member 32 acts to maintain a predetermined interval between the valve body sheet 31 and either the frontal sheet 11 or the rear sheet 12 where the valve body sheet 31 is adhered.

A sixth aspect of the present invention as defined in claim 6 provides the compression bag as defined in claim 5, characterized in that said base member 32 consists of a thread-like material.

A seventh aspect of the present invention as defined in claim 7 provides the compression bag as defined in claim 5, characterized in that the end of at least one of said frontal sheet 11 and rear sheet 12 is separated into two pieces, and one of said two pieces constitutes a valve body sheet 31.

An eighth aspect of the present invention as defined in claim 8 provides the compression bag as defined in claim 5, characterized in that part of the base end side of the valve body sheet 31 positioned near the article containing portion 2 constitutes in the air passageway 3 a bonded part 31*b*, which is adhered to either said frontal sheet 11 or rear sheet 12, and a movable part 31*c* positioned forward from the bonded part 31*b* on the other (front) side of the valve body sheet 31 is movable in the air passageway 3, and the base member 32 is disposed forward from the bonded part 31*b* on the valve body sheet 31, and the inner edge of said base member 32 is positioned, in the direction from the front end of the valve body sheet 31 to the base end side thereof, at or less than a ¾ point of the movable part 31*c*.

A ninth aspect of the present invention as defined in claim 9 provides the compression bag as defined in claim 8, characterized in that the valve body sheet 31 is not adhered to said frontal sheet 11 or rear sheet 12 in any place other than said bonded part 31*b* and a side seal 33 as a sidewall of the air passageway 3, and the base member 32 is not adhered to said frontal sheet 11 or rear sheet 12 in any place other than said side seal 33.

A tenth aspect of the present invention as defined in claim 10 provides the compression bag as defined in claim 5, characterized in that two valve body sheets 31 are utilized, one valve body sheet 31 being adhered to the frontal sheet 11 while the other valve body sheet 31 being adhered to the rear sheet 12, and the base members 32 are respectively disposed between the frontal sheet 11 and the one valve body sheet 31 and between the rear sheet 12 and the other valve body sheet 31.

An eleventh aspect of the present invention as defined in claim 11 provides the compression bag as defined in claim 5, characterized in that a sheet used for the base member 32 is thicker than the valve body sheet 31 and has breathability.

A twelfth aspect of the present invention as defined in claim 12 provides the compression bag as defined in claim 5, characterized in that at least one air passageway 3 is formed.

A thirteenth aspect of the present invention as defined in claim 13 provides the compression bag as defined in claim 5, characterized in that the contact part 31*a* of the valve body sheet 31 which contacts any one of the frontal sheet 11, rear sheet 12, and valve body sheet 31, is provided with an inactive liquid 5 such as silicone oil.

BEST MODE FOR CARRYING OUT THE INVENTION

In the following, one embodiment of the present invention will be described.

Words such as "front and rear", "upper and lower sides, and right and left sides" and "longitudinal and lateral sides" relating to, for example, the frontal and/or rear sheets are used to indicate the positions or the directions of them for the sake of explanation and convenience, and therefore, the present invention should not be construed restrictedly on the basis of the above expressions.

Figure 3:
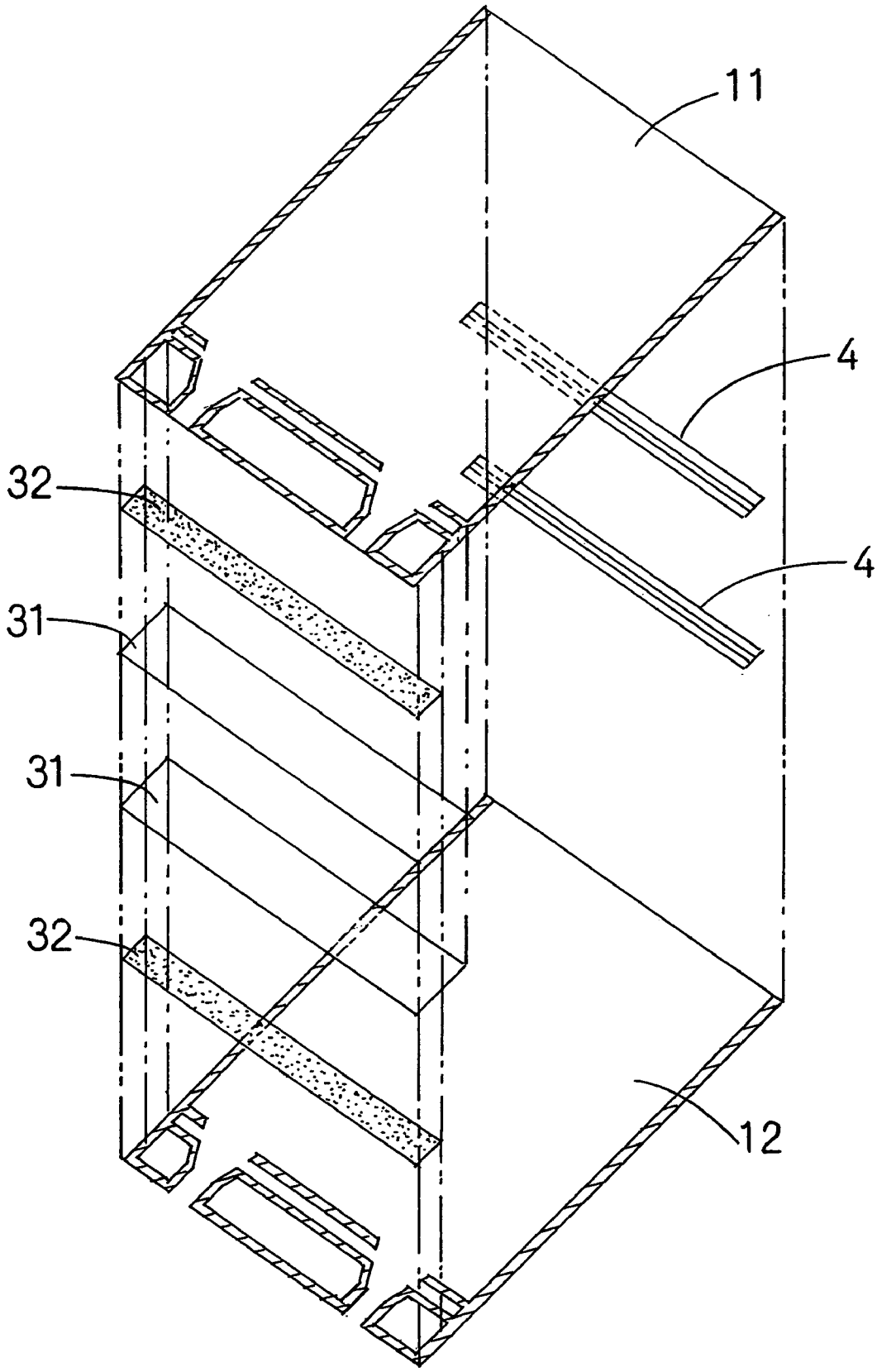
FIG. 3 is an exploded perspective view showing the structure of the embodiment of compression bag in the present invention.

As shown in FIGS. 1 and 3, in the compression bag of this embodiment are used a frontal sheet 11 and a rear sheet 12, both of which are of a longitudinal rectangle, a valve body sheet 31 which is of a lateral rectangle and smaller than the frontal and rear sheets 11, 12 in a longitudinal dimension, and a sheet-like base member 32 which is smaller than the valve body sheet 31 in longitudinal dimension.

Said sheets 11, 12, 31, 32 used as a basic component are of a flexible and long type being supplied without interruption in a longitudinal direction. As will be set forth afterward, the sheets 11, 12, 31, 32 are heat-sealed, and then cut at the predetermined position into a bag body, the space of which has been partitioned into an article containing portion 2 and an air passageway 3.

For the frontal sheet 11, the rear sheets 12, and the valve body sheet 31 is used a resin sheet, which is made of a plurality of resin films, such as laminated polyethylene films or a laminate of polyethylene film and nylon film. A polyethylene film is heat-sealable, but a nylon film is not, so polyethylene films constituting the resin sheet should be placed opposite to each other in heat-sealing the resin sheets, as discussed later.

The frontal sheet 11 and the rear sheet 12 constitute the outside portion of a compression bag 1. An article containing portion 2 is formed between the frontal sheet 11 and the rear sheet 12 having a space for containing an article M. An air passageway 3 has an air-passing space 3*a* continuing from the inner space of the article containing portion 2 to the outside of the compression bag 1 when it is open.

Figure 1A:
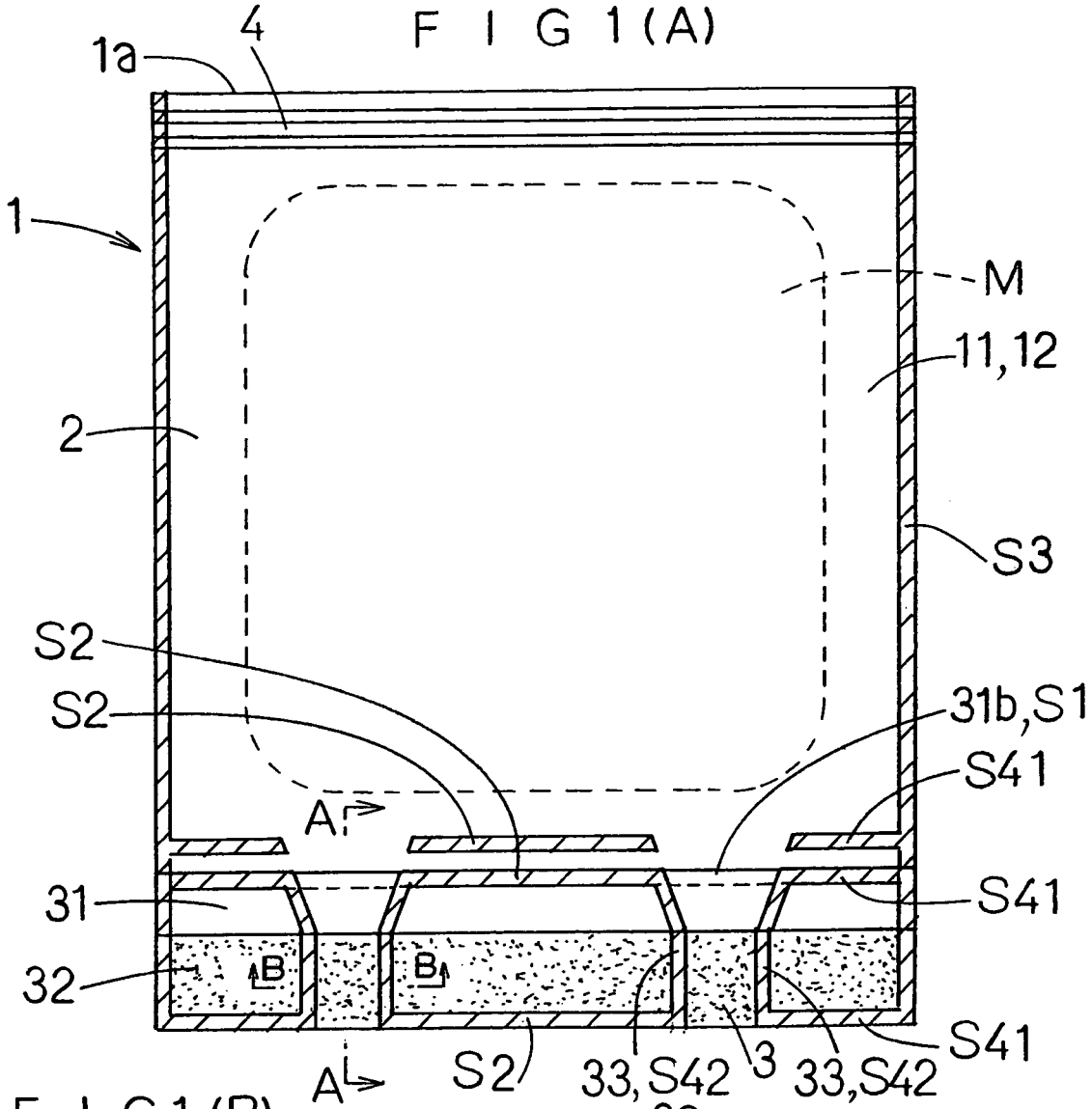
FIG. 1(A) is a plan view showing one embodiment of compression bag in the present invention.

As shown in FIG. 1(A), the frontal sheet 11 and the rear sheet 12 remain unbonded each other at the upper end to make an opening 1*a*. An article M can be inserted or removed from the article containing portion 2 through the opening 1*a*. In this instance, a closing means 4 is provided on the opening 1*a* to be able to close the opening 1*a* airtight. As for said closing means 4, a resin fastener is employed to close the opening 21 by engaging a convexity disposed on either side of the frontal and rear sheets 11, 12 and a concavity disposed on the other, but the closing means 4 should not be limited to this system and variations may be employed. Alternatively, after the article containing portion 2 has contained the article M through the opening 1*a*, the opening 1*a* may be bonded not to open.

Figure 1B:
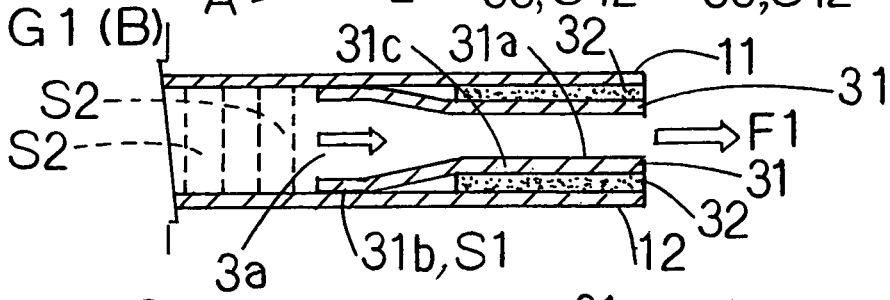
FIGS. 1(B) and 1(C) are cross sectional views as taken along the line A-A in FIG. 1(A).

In this instance, the valve body sheets 31 are positioned on the lower part of the compression bag 1 as shown in FIG. 1(A), and disposed between the frontal sheet 11 and the rear sheet 12 as shown in FIG. 1(B).

Figure 2:
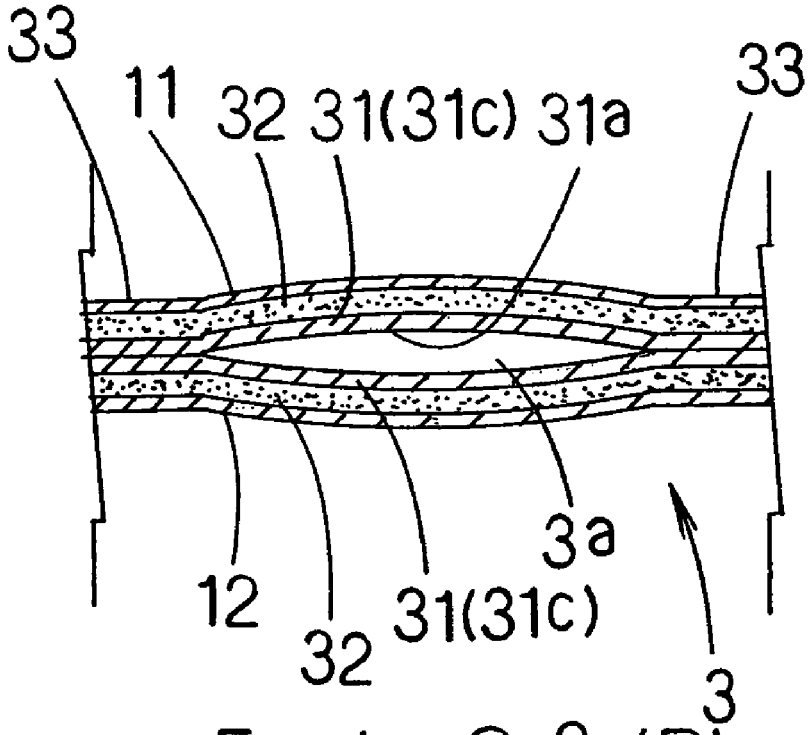
FIG. 2 is a cross sectional view taken along the line B-B, FIG. 2(A) corresponding to the state as shown in FIG. 1(B), and FIG. 2(B) corresponding to the state as shown in FIG. 1(C).
Figure 2:
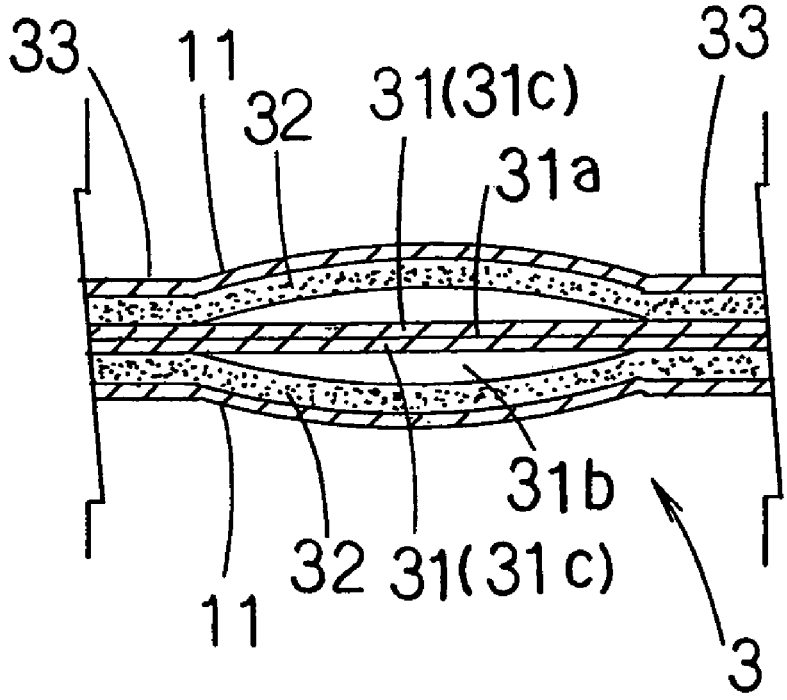

In the air passageway 3, as aforementioned, the air-passing space 3*a* continuing from the inner space of the article containing portion 2 to the outside of the compression bag 1 appears when it is open. In this instance, the air-passing space 3*a* is a space positioned between the two valve body sheets 31 as shown in FIGS. 1(B) and 2(A). As shown in FIG. 1(A), four sides of the air passageway 3 is respectively defined by the article containing portion 2 concerning the upper side, the lower end of the compression bag 1 concerning the lower side, and two side seals 33 as formed in a vertical direction in a manner to unite the frontal sheet 11, the rear sheet 12, the valve body sheet 31, and the base member 32 concerning the right and left sides.

Figure 1C:
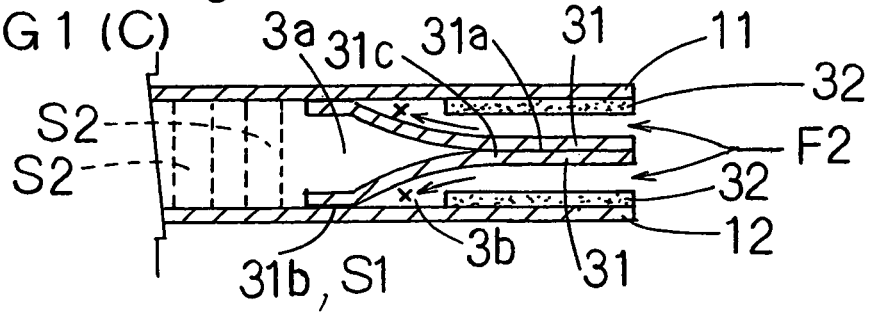

In this instance, part of one valve body sheet 31 positioned at one side, e.g. the frontal side, is adhered to the frontal sheet 11, and part of the other valve body sheet 31 positioned at the other side, i.e. the rear side, is adhered to the rear sheet 12. The adhered portion in the valve body sheet 31 to the frontal or rear sheets 11, 12 turns to be a bonded part 31*b*. And, in this instance, the base end of the valve body sheet 31 (the upper end thereof, and the end side near the article containing portion 2 as shown in FIG. 1(A)) is this bonded part 31*b*. Further, the forward side from the bonded part 31*b* on the valve body sheet 31 (the lower side thereof, and the side away from the article containing portion 2 as shown in FIG. 1(A)) is a movable part 31*c*. This movable part 31*c* in the air passageway 3 is arranged to be able to move in a range from the status where an air-flow F1 can pass from the article containing portion 2 to the outside of the compression bag 1 via the air-passing space 3*a* after the air passageway 3 has been opened as shown in FIGS. 1(B) and 2(A), to the status where the air passageway 3 is closed as shown in FIGS. 1(C) and 2(B). The air passageway 3 can be closed by the movable portion 31*c* of the valve body sheet 31 to rise and contact the opposite movable portion 31*c* of the frontal sheet 11 or the rear sheet 12 where the opposite valve body sheet 31 is attached.

In the valve body sheet 31, a contact face 31*a* is positioned in the reverse side of the face opposite to the frontal sheet 11 or the rear sheet 12 where the valve body sheet 31 is attached, and a contact face 31*a* of one valve body sheet 31 contacts a contact face 31*a* of the other valve body sheet 31 when said air passageway 3 is closed as shown in FIG. 1(C).

The contact between the valve body sheets 31 in closing the air passage way 3 can be caused by a reverse air-flow F2 which is going to flow back from the outside of the compression bag 1 to its inside and blocked by a dead-end 3*b* formed between the frontal sheet 11 or the rear sheet 12 and the valve body sheets 31, and turning into a stagnant air-flow F2 which presses the valve body sheet 31 and achieves a contact of both contact faces 31*a*, as shown in FIG. 1(C).

On contrary to the above, an air-flow F1 which flows in a reverse direction from the article containing portion 2 to the outside spreads the contact between the two valve body sheets 31 to secure an air-passing space 3*a*, as shown in FIG. 1(B). As discussed afterward, in the structure of the air passageway 3 of the present invention, the air passageway 3 has not been pressed by a heated mold in the heat-sealing process, so the pressure resistance taking place in evacuation can be made minimum. This can avoid a conventional problem for the valve body sheets 31 to be heat-sealed by heat in the heat-sealing process, and thus need not excessive pressure in letting an air-flow F1 pass through the air passageway 3. Therefore, in accordance with the present invention, even those who have relatively less power such as children or the aged can evacuate the air in the article containing portion 2 to the outside of the compression bag 1 by manually pressing the article containing portion 2 with the least pressure resistance. In addition to this, the article containing portion 2 will not burst.

Figure 4:
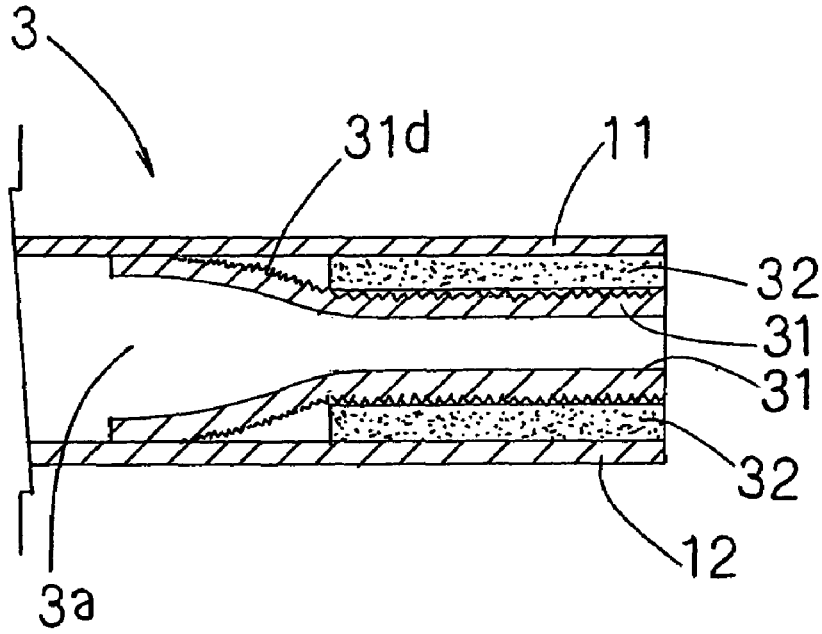
FIGS. 4(A) and 4(B) are respectively cross sectional views explanatory of an air passage of another embodiment of compression bag in the present invention.
Figure 4:
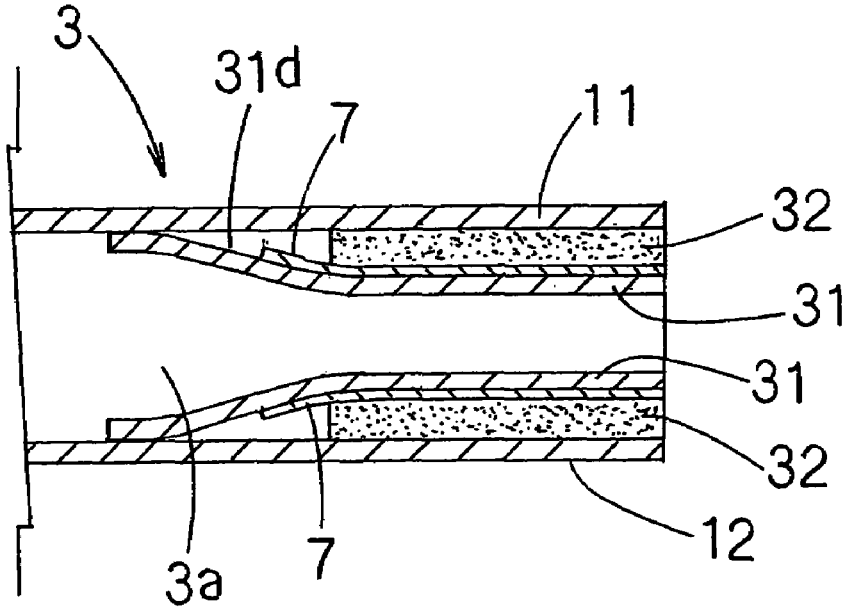

As shown in FIG. 4, the arrangement may be made such that a separating face 3*d* on the reverse side of the contact face 31*a* may have negative attribution of contacting compared to the contact face 31*a*, so the valve body sheets 31 can easily rise from the frontal sheet 11 or the rear sheet 12 where the sheet is attached, or from the base member 32 as described later. Specifically, this can be embodied by the formation of an uneven separating face 31*d* as satin-finished as shown in FIG. 4(A), or by applying a coating material to the separating face 31*d* for easier separation, as shown in FIG. 4(B).

Figure 5:
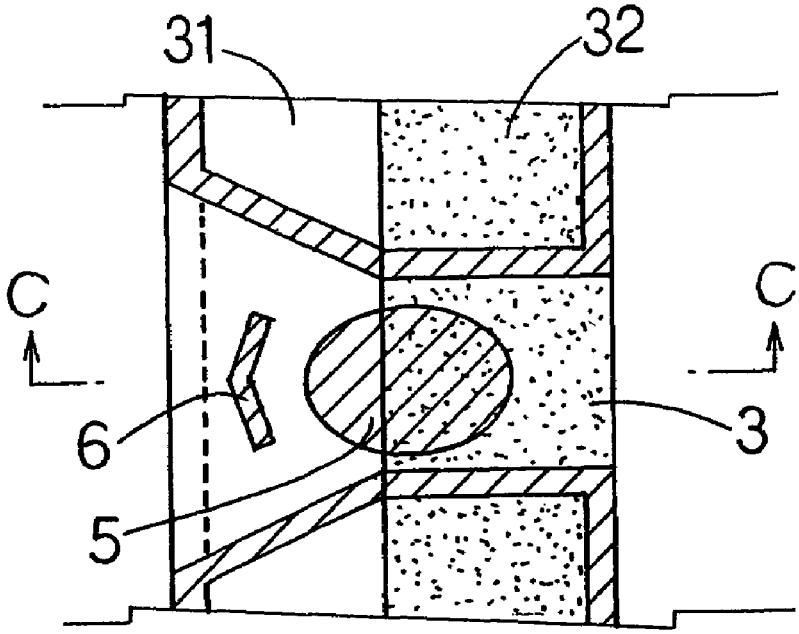
FIG. 5(A) is a partially enlarged plan view of the air passage of another embodiment of compression bag in the present invention.
FIG. 5(B) is a cross sectional view showing the same taken along the line C-C in FIG. 5(A).
Figure 5:
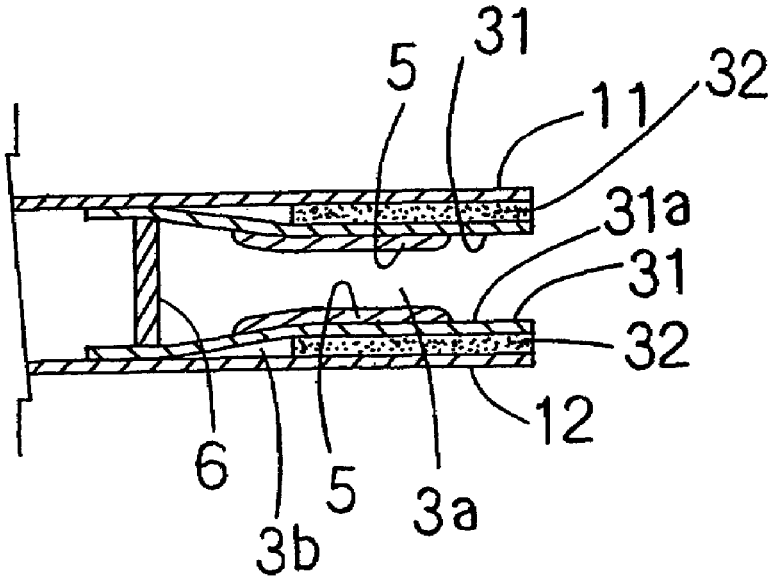

Meanwhile, as for the contact face 31*a*, it is desirable for the contact face 31*a* to have positive attribution of contacting in view of effective closing of the air passageway 3. For example, application to the contact face 31*a* of inactive liquid 5 such as silicone oil with the amount of causing no trouble to evacuation is applied to the contact face 31*a* can make the valve body sheets 31 to easily contact each other, which may effectively avoid a reverse air-flow in the air passageway 3, as shown in FIGS. 5(A) and 5(B). In the shown examples, a liquid stop seal 6 is formed by heat-sealing the valve body sheets 31 positioned closer to the article containing portion 2 than the inactive liquid 5 as shown in FIG. 5(A) in order to prevent said inactive liquid 5 from flowing into the article containing portion 2 to taint the article M therein.

Besides said valve body sheets 31, a base member 32 is provided in a fashion to overlap at least part of the valve body sheets 31 in the air passageway 3. In this instance, said base member 32 of a sheet type is disposed to overlap the valve body sheets 31 at the lower side of the valve body sheets 31 as shown in FIG. 1(A), more specifically, at the forward side from the bonded part 31*b*. The inner edge of the base member 32 is positioned at a ½, preferably ¾ or less, point of the movable member 31*c* in the direction from the front end of the valve body sheet 31 (the lower side in FIG. 1(A)) to the base end thereof (the upper side in the same Figure). The base member 32 rests ranging from the lower side of the compression bag 1 to the article containing portion 2 in a length of 30 mm or less, with its end coinciding with that of the valve body sheet 31 in the position of the base member related to the valve body sheet 31, but they may be in a slight offset position with respect to one another.

In the air passageway 3, the base member 32 is bonded solely at the position of the side seal 33 to the frontal sheet 11, the rear sheet 12 and the valve body sheet 31, as shown in FIGS. 2(A) and 2(B). In other words, the base member 32 has no bonded area within the air passageway 3, that is, simply being sandwiched between the frontal sheet 11 or the rear sheet 12 and the valve body sheet 31, whereby the air-passing space 3*a* appears when the air passageway 3 is open as shown in FIGS. 1(B) and 2(A), to ensure that an air-flow F1 from the article containing portion 2 to the outside of the compression bag 1 may pass smoothly.

The base member 32 is made of a sheet which is thicker compared to the frontal and rear sheets 11, 12, and valve body sheets 31, which can diminish by its own thickness a distance between one valve sheet 31 with the member and the sheet which the very valve sheet 31 contacts such as a frontal sheet 11, a rear sheet 12 or the other valve sheet 31. Therefore, easy blocking of the air passageway 3 by the valve body sheet 31 may be ensured, thereby effectively preventing a reverse air-flow in the air passageway 3 and maintaining a long-term evacuated condition in the article containing portion 2.

For the purpose of guiding the air smoothly to a dead-end 3*b* formed between the frontal sheet 11 or the rear sheet 12 and the valve body sheet 31, a breathable sheet material is preferable to the base member 32, and bonded cloth, reticulation, woven fabric, all of them having heat-sealability and made of thermoplastic resin fiber, can be exemplified. Other materials such paper without sealability can be utilized as that of the base member 32 if the latter is bonded to the sheets 11, 12, 31, 32 by adhesive and the like. In some cases may be used non-breathable resin sheets like the frontal sheet 11, rear sheet 12, and valve body sheet 31.

Figure 9A:
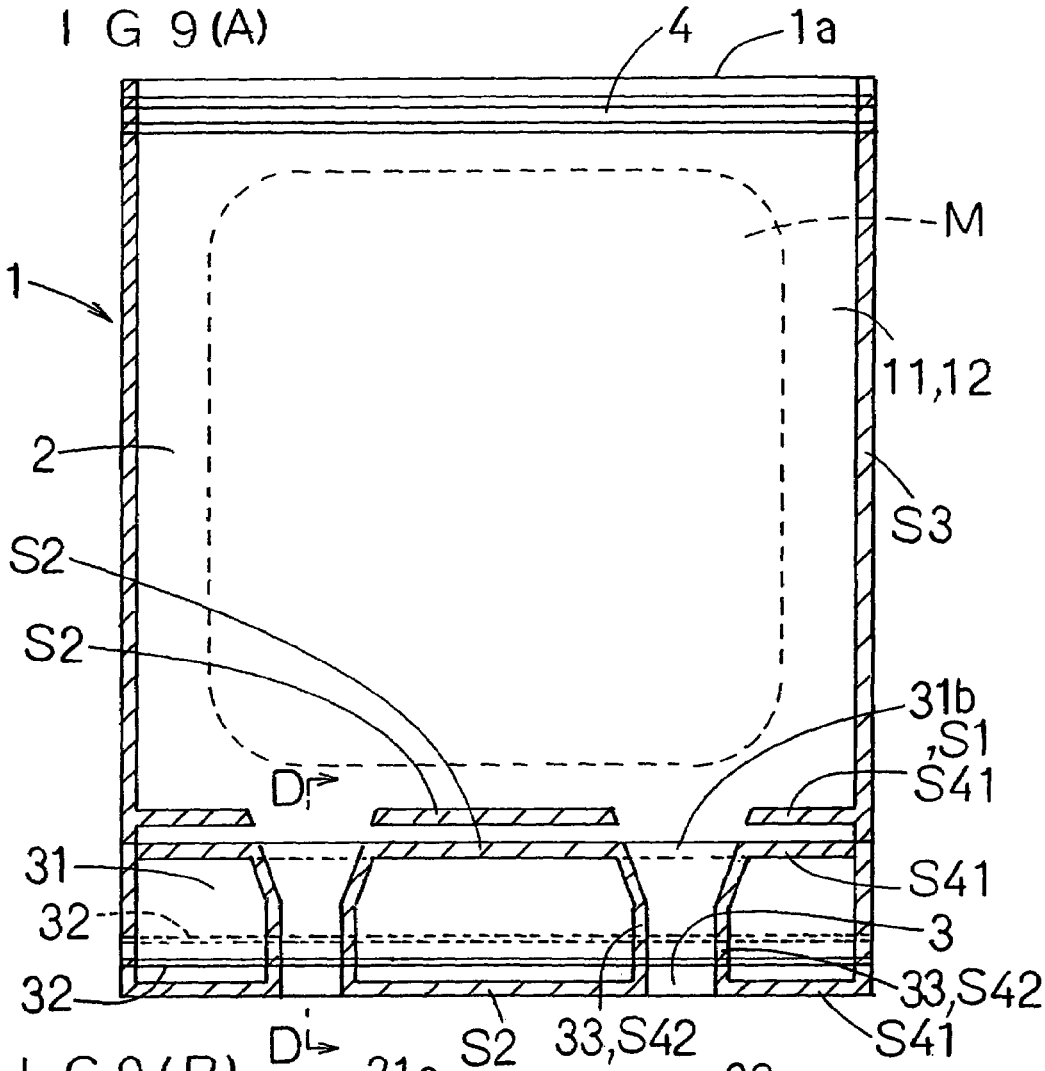
FIG. 9(A) is a plan view showing another embodiment of compression bag in the present invention.
Figure 9B:
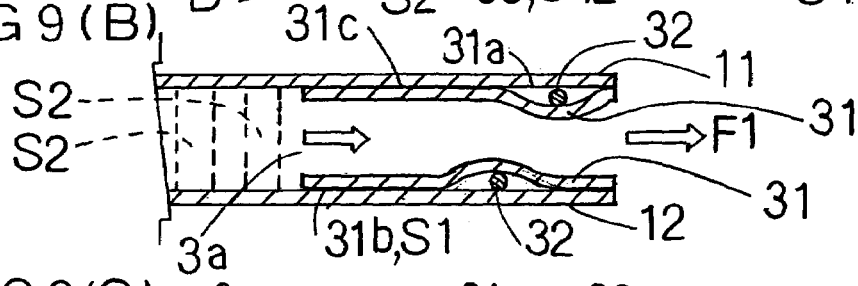
FIGS. 9(B) and 9(C) are side views taken along the line D-D.
Figure 9C:
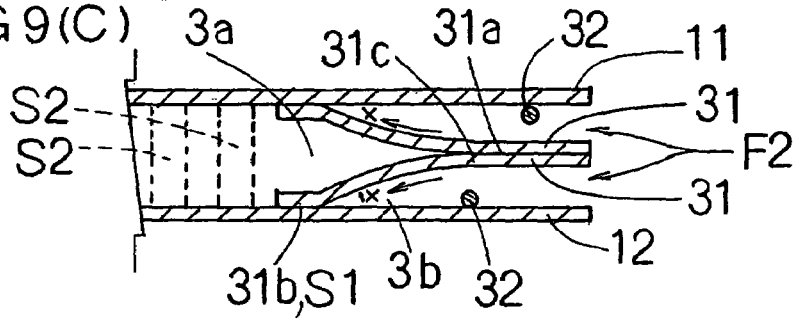

As shown in FIGS. 9(A)-9(C), the base member 32 may be made of a thread-like material. In this case, a thread-like material of thermoplastic resin fiber such as polyester resin fiber having heat-sealability may be preferably used, and even a thread-like material made of natural fiber like cotton without heat-sealability is also usable.

In this embodiment, as shown in FIG. 9(B), one base member 32 adhered to the frontal sheet 11 and the other base member 32 adhered to the rear sheet 12 alternate with each other in position. This enables the valve body sheet 31 to protrude toward the air-passing space 3*a* in each of the positions where the base members 32 are situated, resulting in increasing the effect to prevent a reverse air-flow.

Thus, applying a thread-like material to the base member 32 can make small of the movable portion 31*c* of the valve body sheet 31, which contacts the base member 32, thereby making it possible for the valve body sheet 31 to diminish the size of its whole width. In manufacturing the compression bag 1, unlike the case in which the base member 32 is made of the above-described sheet-like material, it is not necessary for the base members 32 of a continuous length to be supplied in parallel with each of the frontal sheet 11, rear sheet 12, and valve body sheet 31 prior to the step (the step [2] as mentioned later on) of overlying the base members 32 on the frontal sheet 11 and rear sheet 12 respectively before doing them on the valve body sheet 31 as well, so the base members 32 may be freely made into a bent form or others, which is advantageous for a layout of the production system.

In the embodiment as shown in FIG. 9, the thread-like base members 32 are disposed on the frontal sheet 11, and the rear sheet 12 piece by a piece respectively, but two pieces or more of the thread-like base members 32 may be disposed on the frontal sheet 11 and/or the rear sheet 12.

Figure 6:
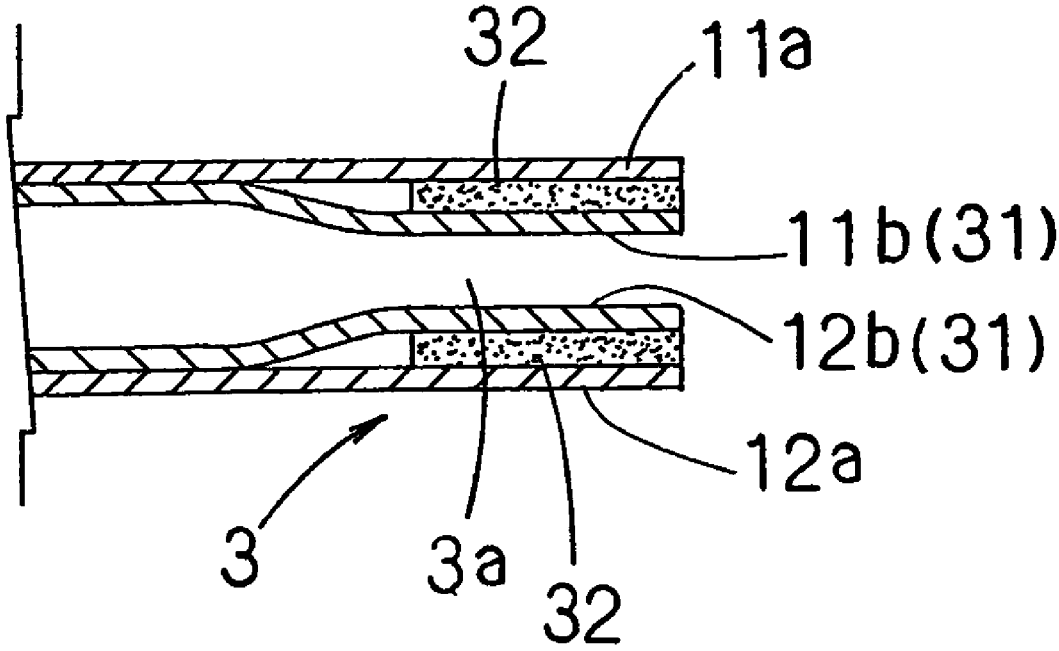
FIGS. 6 (A) and 6(B) are respectively cross sectional views explanatory of the air passage of another embodiment of compression bag in the present invention.
Figure 6:
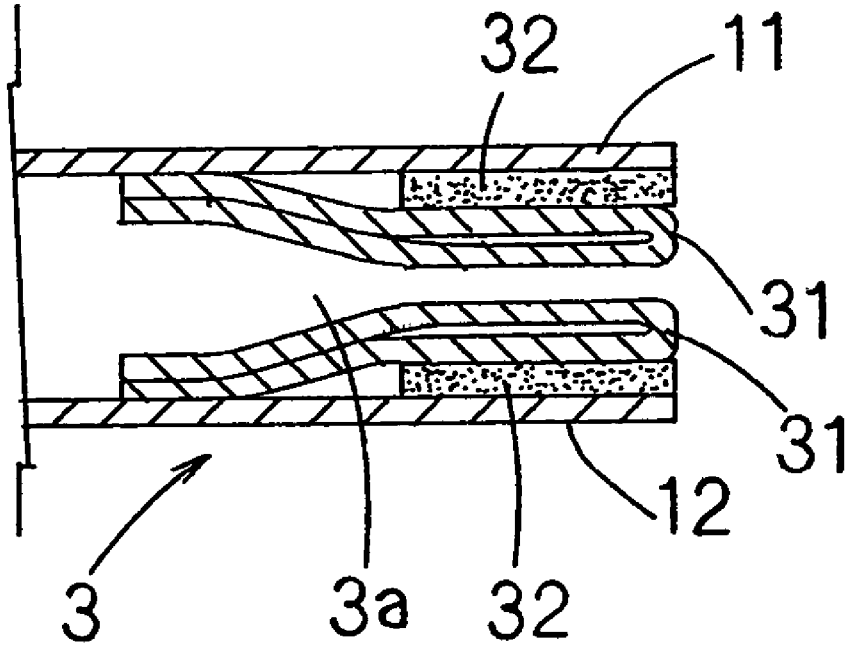
Figure 7:
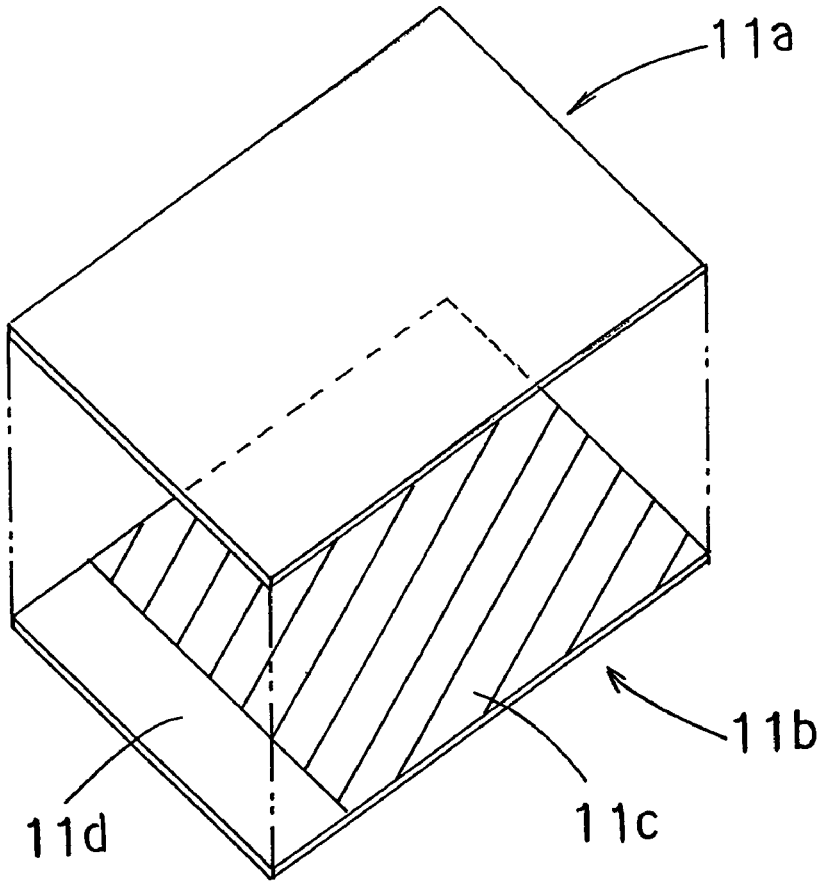
FIGS. 7(A) and 7(B) are views explanatory of the arrangement of a frontal sheet used in the compression bag as shown in FIG. 6(A).
Figure 7:
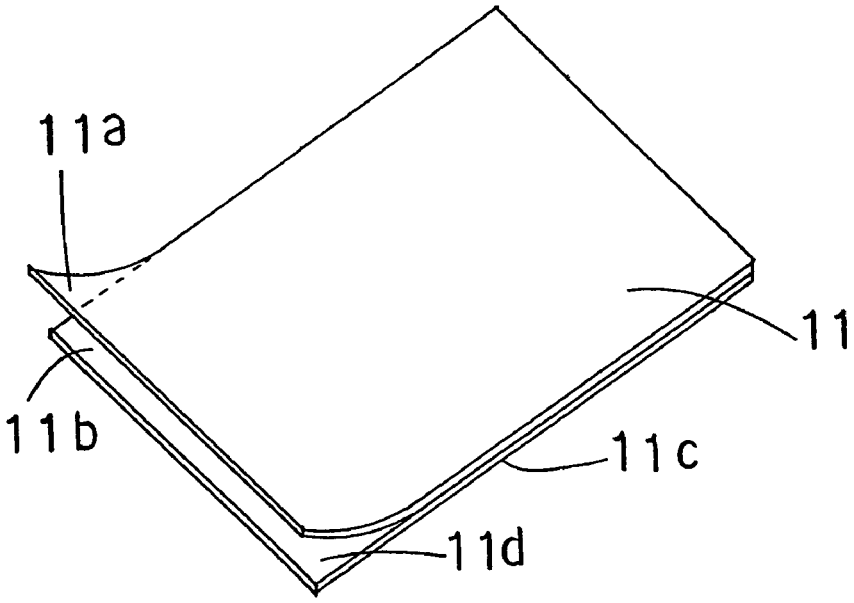

Though a description that all of the frontal sheet 11, rear sheet 12 and valve body sheets 31 have been made as a separate sheet, the frontal sheet 11 and valve body sheet 31 or the rear sheet 12 and valve body sheet 31 may be formed integral with each other. Said frontal sheet 11 and rear sheet 12 are each composed of sticking layers of resin films such as polyethylene films or nylon films. In a frontal sheet 11 consisting of two layers of resin films, for example, resin films 11*a*, 11*b* of the frontal sheet 11 are overlaid each other with an adhering area 11*c* coated with adhesive while a non-adhering area 11*d* is not coated, as shown in FIG. 7(A), being able to leave only the non-adhering area 11*d* separate between the resin films 1*a*, 11*b*, as shown in FIG. 7(B). And an area of the non-adhering area 11*d* is utilized as an air passageway 3. That is, as shown in FIG. 6(A), in placing the resin film 11*a* at the outer side of the compression bag 1, the outside resin film 11*a* may be used as an equivalent of the frontal sheet 11 as shown in FIG. 1(B), as well as the inside resin film 11*b* as an equivalent of the valve body sheet 31 as shown in FIG. 1(B). This also applies to the rear sheet 12, when the resin film 12*a* is placed at the outer side of the compression bag 1, the outside resin film 12*a* may be used as an equivalent of the rear sheet 12 as well as the inside resin film as an equivalent of the valve body sheet 31. Now, even when the frontal sheet 11 and rear sheet 12 consist of three layers or more of resin films, the same structure as said two layers of resin films is available by providing a non-adhered area like the abovementioned one between at least one of these layers.

In this instance, two flat sheets are used for the valve body sheets 31 which are attached to the frontal sheet 1 and the rear sheet 12 respectively, but the valve body sheets 31 may be in a folded style, as shown in FIG. 6(B).

Figure 8:
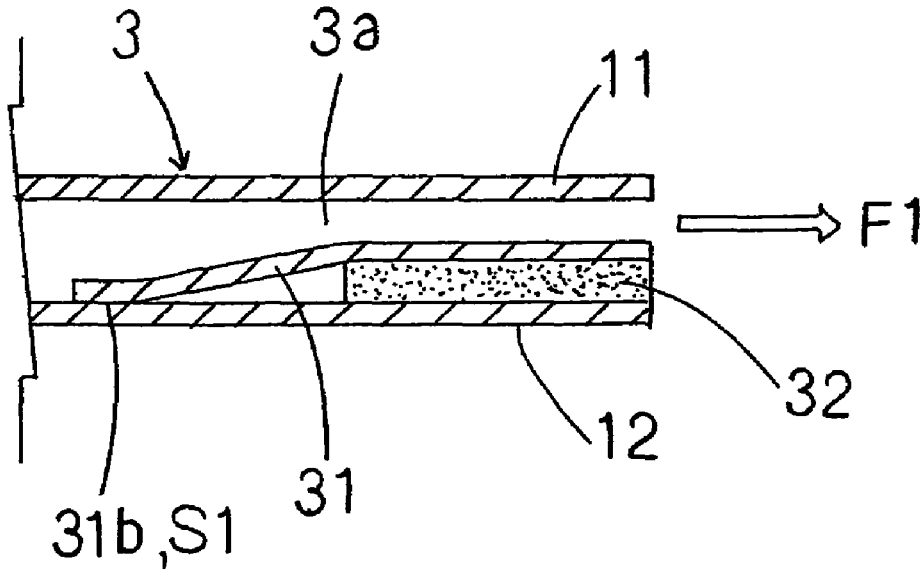
FIGS. 8(A) and 8(B) are partially enlarged plan view of the air passage of another embodiment of the compression bag in the present invention.
Figure 8:
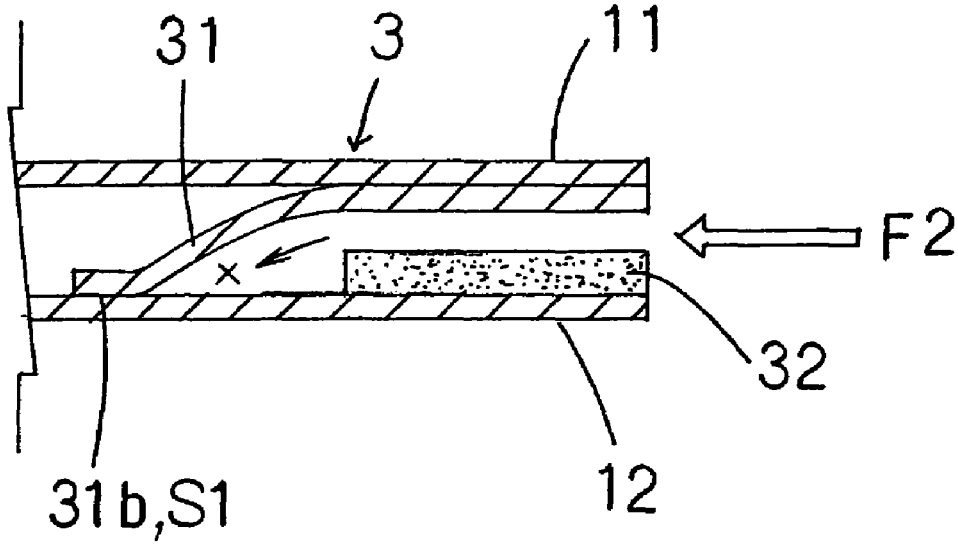

Also, the valve body sheet 31 can be a single piece used per compression bag 1, in which the sheet is attached only on either the frontal sheet 11 or the rear sheet 12, as shown in FIG. 8. In this case, the object which the contact part 31*a* of the valve body sheet 31 contacts is either the frontal sheet 11 or the rear sheet 12. With this specific valve body sheet 31, the air-flow F1 can pass through the air-passing space 3*a* of the air passageway 3 being open to pass from the article containing portion 2 to the outside of the compression bag 1 as shown in FIG. 8(A) until the passageway 3 is closed by the valve body sheet 31 which has contacted the frontal sheet 11, as shown in FIG. 8(B).

Figures 10A, 10B:
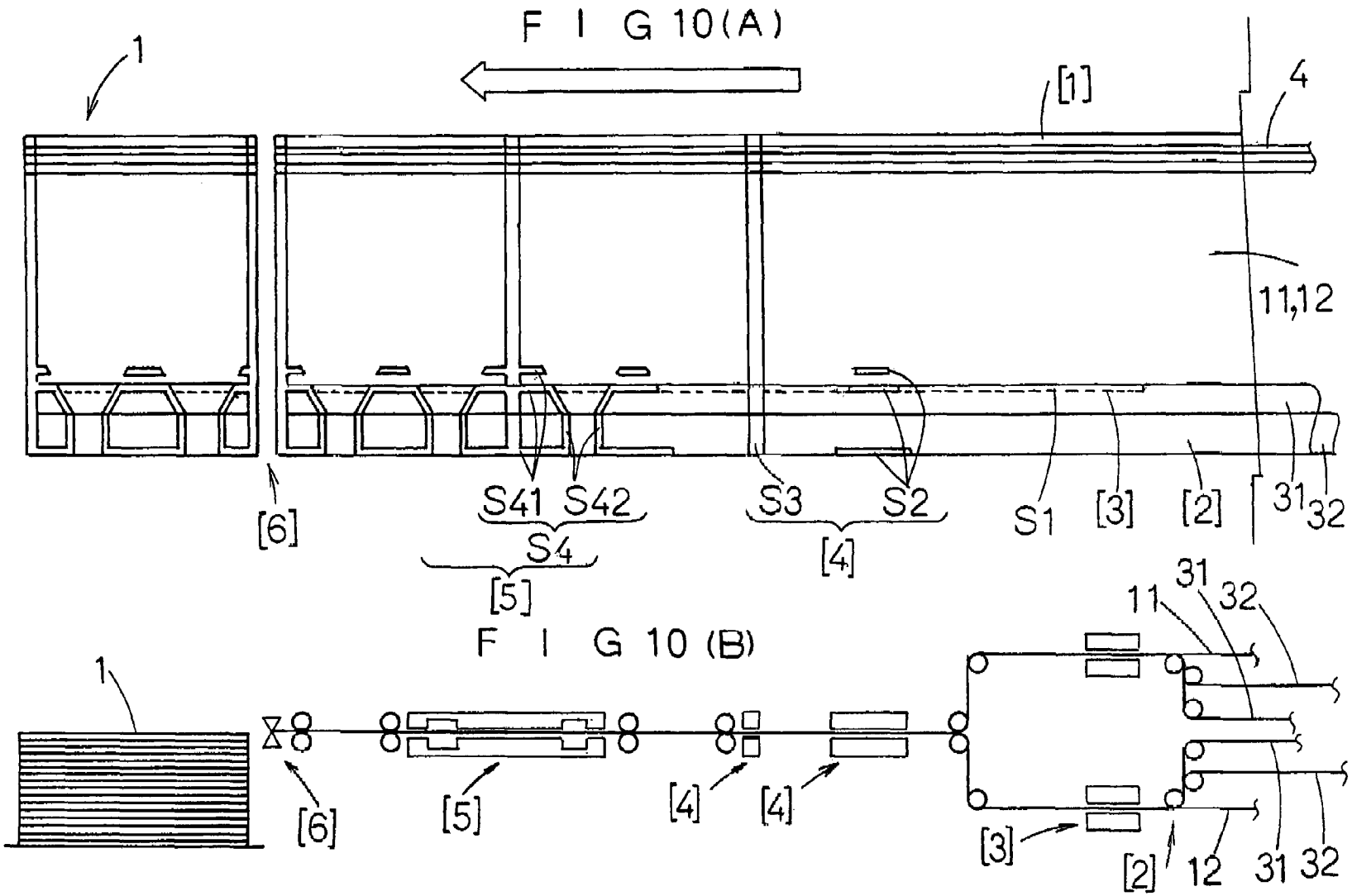
FIG. 10(A) is a plan view explanatory of the production course of one embodiment of compression bag in the present invention.
FIG. 10(B) is a front view explanatory of the same.

Next, a production method for the compression bag 1 in accordance with the present invention will be described. In manufacturing the compression bag 1 of this embodiment are used longitudinally continuous sheets for the frontal sheet 11, rear sheet 12, valve body sheets 31, and base members 32, all of which are, as shown by arrows in FIG. 10, continuously supplied in the steps as discussed afterward so as to be subjected to heat-sealing and cutting in sequence.

First, a closing member 4 is mounted by heat-sealing to the top end of the frontal sheet 11 and the rear sheet 12, which is to constitute an opening 1*a* of the finished compression bag 1. (Step [1]) In this instance, a fastener having a convexity on one of the frontal and rear sheets 11, 12 and a concavity on the other is used for the closing member 4, and is continuously supplied to respective steps in a longitudinal direction without interruption, as in said sheets.

As said closing member 4 is mounted, the base members 32 are laid over the frontal sheet 11 and the rear sheet 12 respectively, and the valve body sheets 31 as well are laid over. (Step [2]) Then, the valve body sheets 31 are adhered to the frontal sheet 11 and the rear sheet 12 by valve body bonding seals S1 of heat-seal. (Step [3]) Where this valve body bonding seal S1 is applied is a bonded part 31*b* in the valve body sheet 31, as shown in FIG. 1.

In the above-described state, the base members 32 are simply sandwiched between the frontal sheet 11 or the rear sheet 12 and the valve body sheet 31, and are not bonded. And the frontal sheet 11 and the rear sheet 12 in this stage remain separate from each other in order for the valve body sheet 31 attached to the frontal sheet 11 and the other valve body sheet 31 attached to the rear sheet 12 not to be influenced by the heat out of said heat-sealing.

Then, the frontal sheet 11 and rear sheet 12, which the valve body sheets are adhered to respectively and the base members 32 have been laid over as mentioned above, are laid on one another in a manner that the valve body sheets 31 face opposite. The overlapped sheets 11, 12, 31, 32 are provided a central seal S2 and a bag side seal S3, and bonded altogether. (Step [4])

The central seals S2 in the finished compression bag 1 are formed in the central part near the valve body sheet 31 to extend in a longitudinal direction (lateral direction in the drawing), and three lines of them are formed in this embodiment. A top of them intends to guide an air-flow (referred to as F1 in FIG. 1(A)) flowing from the article containing portion 2 to the outside of the compression bag 1, and to reinforce the frontal sheet 11 and the rear sheet 12. A middle intends to zone the article containing portion 2 and the air passageway 3. A bottom intends to define the bottom end of the compression bag 1 and put the sheets 11, 12, 31, 32 together.

A bag side seal S3 is intended to define the right and left end parts of the compression bag 1 and put the sheets 11, 12, 31, 32 together.

Next, at the right and left sides of the central seal S2 are formed a right-side and a left-side seals S4. (Step [5]) Said right-side and left-side seals S4 comprise a right-and-leftward (lateral direction) seal S41 and an up-and-downward (vertical direction) seal S42, the right-and-leftward seal S41 being formed in a longitudinal direction (right and left directions in the drawing), and being formed side by side in three rows in this embodiment, functioning same as the central seal S2.

Said up-and-downward seal S42 is namely the side seals 33 as already explained, being positioned on the right and left sides of the air passageway 3 in the finished compression bag 1, as shown in FIG. 1(A). Thus, the air passageway 3 is defined at its right and left ends by the up-and-downward seal S42. The top end of the air passageway 3 is defined by an extensive lined position of the intermediate part between the central seal S2 and the right-and-leftward seal S41. This specified position is arranged to conform to the top end of the valve body sheet 31 and the position of the valve body bonding seal S1 in this embodiment, but they may be positioned slightly distant from each other, so other variations are available. And, the bottom end of the air passageway 3 is defined by the bottom end of the frontal sheet 11 and rear sheet 12.

The above-described seals S1 to S4 are formed by a heated mold pressing the sheets 11, 12, 31, 31. With said procedure of forming the seals S1 to S4, no mold pressing and consequent heat-sealing is applied to a part in the sheets 11, 12, 31, 31 corresponding to the area where the air-flow passes, thus leaving the air passageway 3 unclosed thanks to the valve body sheets 31 not adhered each other, unlike conventional one that has been lightly bonded by the heat in heat-sealing, resulting in not requiring much force to open the air passageway 3 when the air in the article containing portion 2 is manually evacuated out of the compression bag 1 by pressing the article containing portion 2, so even those who have relatively less power such as children or the aged can evacuate it with the least pressure resistance.

As foregoing, the valve body bonding seals S1 are separately disposed beforehand between the frontal sheet 11 and the valve body sheet 31, and between the rear sheet 12 and the valve body sheet 31. In this process, as the frontal sheet 11 and the rear sheet 12 remain apart, the heat generated in forming the valve body bonding seal S1 has no thermal influence on the air passageway 3.

Finally, the sheets 11, 12, 31, 32 and the closing means 4 are severed by halving said side seal s3 in a vertical direction in the drawing to finish a compression bag 1. (Step [6])

Figure 11A:
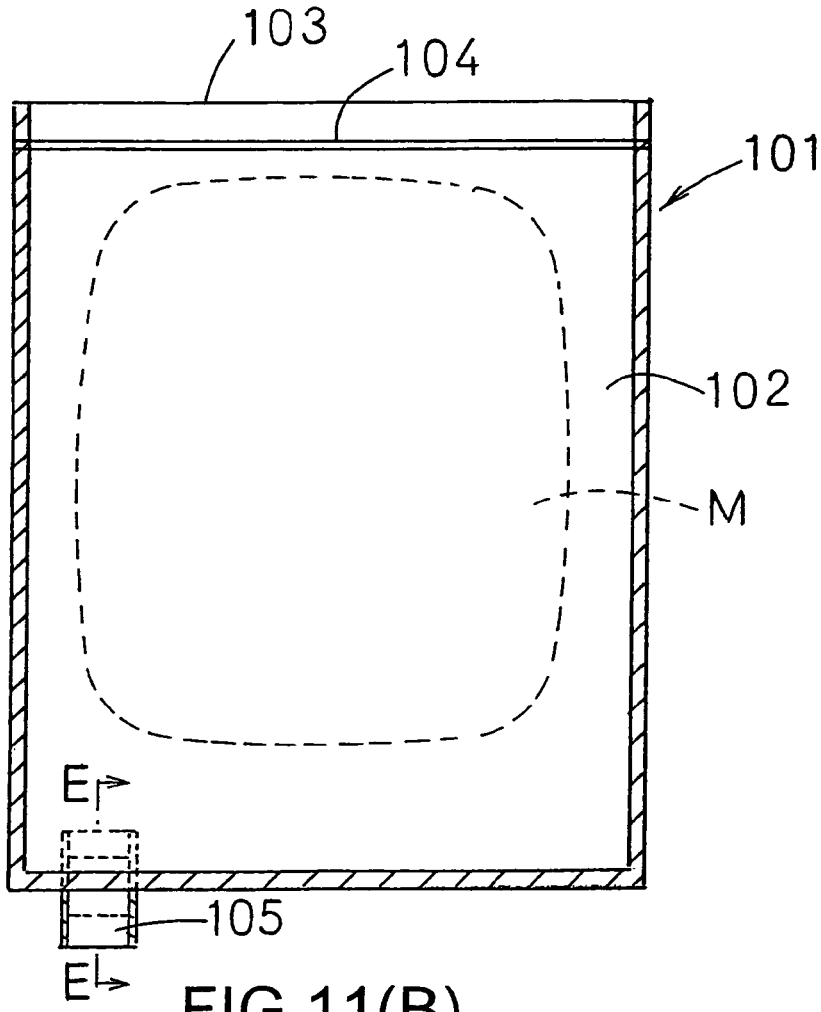
FIG 11(A) PRIOR ART
FIG. 11(A) is a plan view showing a conventional compression bag.
Figure 11B:
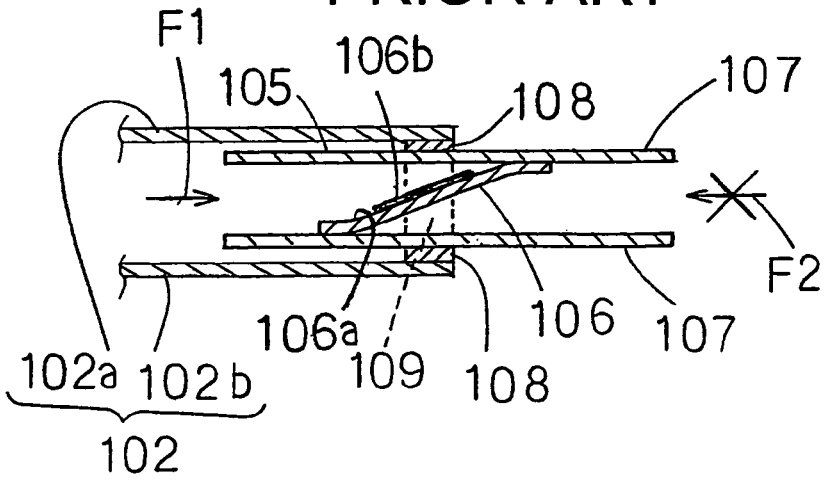
FIG 11(B) PRIOR ART
FIG. 11(B) is a cross sectional view taken along the line E-E of FIG. 11(A).
Figure 12:
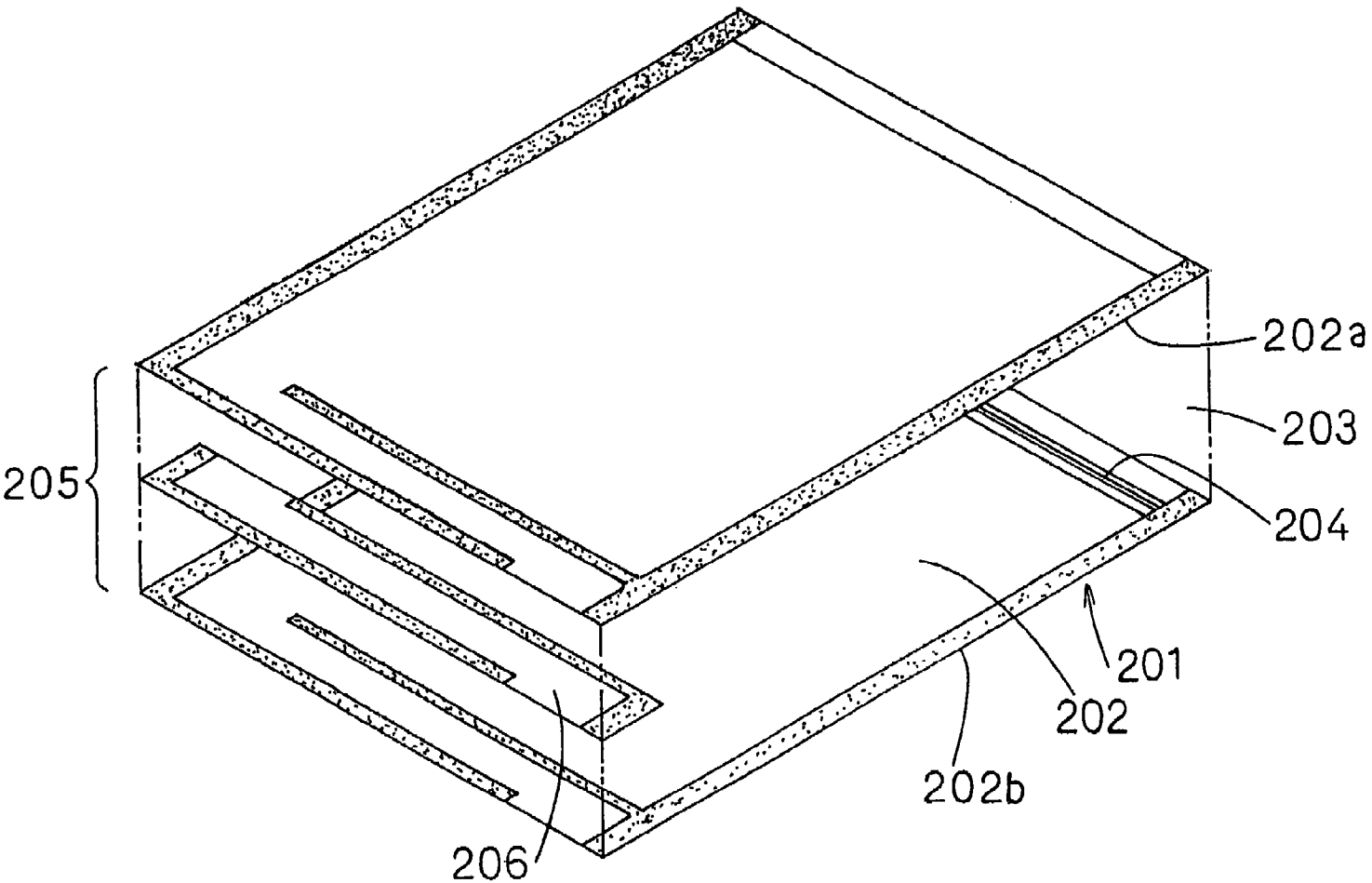
FIG 12 PRIOR ART
FIG. 12 is an exploded perspective view showing the structure of another conventional compression bag.

In a production method for the compression bag 1 in accordance with the present invention, longitudinally continuous sheets 11, 12, 31, 32 and the closing means 4 are supplied to each step ([1] to [6]) in succession to be subjected to heat-sealing and severing in sequence so that the compression bags 1 are to be completed one after another, which needs no use of the known complicated production process, as shown in FIG. 11, where a check valve 105 is manufactured apart from the sheets constituting the article containing portion 102, being incorporated in the article containing portion 102 which is formed at a later stage, resulting in reduction of the production costs.

The present invention has the following advantageous effects.

In accordance with the aspects of the present invention as defined in claims 1 and 2, the base member 32 disposed between the valve body sheet 31 and at least one of the frontal and rear sheets 11, 12 can diminish by the member's own thickness a distance between one valve body sheet 31 and the sheet which the valve body sheet 31 contacts, whereby easy blocking of the air passageway 3 by the valve body sheet 31 may be ensured, and the compression bag 1 which can securely retain the article containing portion 2 evacuated can be produced by a series of steps done by continuous supplying of the plural sheets 11, 12, 31, 32 in a longitudinal direction, which may reduce the production costs.

In accordance with the aspect of the present invention as defined in claim 3, in addition to the effect of the aspect of claim 1, the movable part 31*c* of the valve body sheet 31, which contacts the base member 32, can be made small, thereby making it possible for the valve body sheet 31 to diminish the size of its whole width.

In accordance with the aspect of the present invention as defined in claim 4, in addition to the effect of the aspect of claim 1, a compression bag 1 in which smooth evacuation can be manually done with the least pressure resistance can be produced because the sheets 11, 12, 31, 32 are not applied to mold for heat-sealing at where the air passageway 3 is formed, thereby opening the air passageway 3 easily.

In accordance with the aspect of the present inventions as defined in claims 5, 7, 8, 10, and 12, the base member 32 disposed between at least one of the frontal sheet 11 and rear sheet 12 and the valve body sheet 31 can by the member's own thickness a distance between one valve body sheet 31 and the sheet which the valve body sheet 31 contacts, whereby easy blocking of the air passageway 3 by the valve body sheet 31 may be ensured, and the compression bag 1 which can securely retain the article containing portion 2 evacuated can be produced.

In accordance with the aspect of the present invention as defined in claim 6, in addition to the effect of the aspect of claim 5, the movable part 31*c* of the valve body sheet 31, which contacts the base member 32, can be made small, thereby making it possible for the valve body sheet 31 to diminish the size of its whole width.

In accordance with the aspect of the present invention as defined in claim 9, in addition to the effect of the aspect of claim 8, a compression bag 1 in which smooth evacuation can be manually done with the least pressure resistance can be produced because the valve body sheet 31 is not adhered to said frontal sheet 11 or rear sheet 12 in any place other than said bonded part 31*b* and a side seal 33 as a sidewall of the air passageway 3, and that the base member 32 is not adhered to said frontal sheet 11 or rear sheet 12 in any place other than said side seal 33, thereby opening the air passageway 3 easily.

In accordance with the aspect of the present invention as defined in claim 11, in addition to the effect of the aspect of claim 5, a sheet used as the base member 32 is thicker than the valve body sheet 31 and have breathablility, thereby guiding the air smoothly to a dead-end 3*b* formed between the frontal sheet 11 or the rear sheet 12 and the valve body sheet 31, evacuated condition in the article containing portion 2.

In accordance with the aspect of the present invention as defined in claim 13, in addition to the effect of the aspect of claim 5, the contact part 31*a* of the valve body sheet 31 which contacts any one of the frontal sheet 11, rear sheet 12, and valve body sheet 31, is provided with an inactive liquid 5 such as silicone oil, which is adapted to attach to any one of the frontal sheet 11, rear sheet 12, and valve body sheet 31, thereby permitting easy adherence between the valve body sheets 31 for effective prevention of an backward air-flow in the air passageway 3.

What is claimed is:

1. A production method for compression bag comprising:

a plurality of longitudinal continuous components of flexible resin sheets, the sheets being continuously supplied in a longitudinal direction to lie one upon another and then bonded at predetermined positions so as to form an article containing portion having a space for an article and an air passageway having a space continuing to the space of the article containing portion, wherein said components comprise a frontal sheet;

a rear sheet which is equal to the frontal sheet in breadth dimension being a transverse side dimension of the sheets;

at least one valve body sheet disposed between said frontal and rear sheets and made smaller than said frontal and rear sheets in breadth dimension; and a base member disposed in a manner to be layered between at least one of the frontal sheet and the rear sheet to which the valve body sheet is bonded, and the valve body sheet bonded to said sheet, and is made smaller than the valve body sheet in breadth dimension, and the process comprising:

a step of placing the valve body sheet and the base member laid thereon between the frontal sheet and the rear sheet;

a step of bonding said disposed components at predetermined positions, wherein side seals acting as a sidewall of the air passageway are formed in the step of bonding said components in respect of forming the air passageway.

2. The production method for compression bag as defined in claim 1, wherein said components are composed of a plurality of laminated resin films, and said valve body sheet is at least part of either the frontal sheet or the rear sheet, and has been formed as at least one of the resin films that constitute said frontal sheet and rear sheet, and remain unbonded in a certain adjacent therebetween.

3. The production method for compression bag as defined in claim 1, wherein said base member consists of a material having threads.

4. The production method for compression bag as defined claim 1, wherein the bonding of said components is done by heat-sealing by pressing a heated mold against said components, and the heat-seal as formed by said heated mold is not provided in the position where said air passageway is formed.

5. A compression bag comprising:

components including a plurality of flexible resin sheets, the sheets being laid one upon another and then bonded at predetermined positions so as to form an article containing portion having a space for an article and an air passageway having a space continuing to the space of the article containing portion, wherein said components comprises:

a frontal sheet;

a rear sheet disposed opposite to the frontal sheet; and at least one valve body sheet disposed between the frontal sheet and the rear sheet, the valve sheet having a part bonded to the frontal sheet or the rear sheet and a remaining part except for the bonded part being arranged to move to or away from the frontal sheet or the rear sheet; and a base member disposed in a manner to be layered between at least one of the frontal sheet and the rear sheet to which the valve body sheet is bonded as mentioned above, and the valve body sheet bonded to said sheet, wherein the air passageway is defined by two side seals formed by bonding said sheets in a direction from the article containing portion to the outside of the compression bag, the valve body sheet acts to block an air-flow passing through the air-passageway by a contact part which is on the reverse side of the area attached to said frontal sheet or rear sheet to contact any one of the frontal sheet, rear sheet, and valve body sheet disposed opposite to the contact part, and the base member acts to maintain a predetermined interval between the valve body sheet and either the frontal sheet or the rear sheet where the valve body sheet is adhered.

6. The compression bag as defined in claim 5, wherein said base member consists of a threaded material.

7. The compression bag as defined in claim 5, wherein an end of at least one of said frontal sheet and rear sheet is separated into two pieces, and one of said two pieces constitutes the valve body sheet.

8. The compression bag as defined in claim 5, wherein two valve body sheets and two base members are utilized, and wherein one valve body is adhered to the frontal sheet, the other valve body sheet is adhered to the rear sheet, and one base member is disposed between the frontal sheet and the one valve body sheet and the other base member is disposed between the rear sheet and the other valve body sheet.

9. The compression bag as defined in claim 5, a sheet used for the base members is thicker than the valve body sheet and has breathability.

10. The compression bag as defined in claim 5, wherein the contact part of the valve body sheet which contacts any one of the frontal sheet, rear sheet, and valve body sheet, is provided with an inactive liquid.

11. The compression bag as defined in claim 5, wherein the contact part of the valve body sheet which contacts any one of the frontal sheet, rear sheet, and valve body sheet, is provided with a silicone oil.

12. The compression bag as defined in claim 5, wherein part of the base end side of the valve body sheet positioned close to the article containing portion constitutes in the air passageway a bonded part, which is adhered to either said frontal sheet or rear sheet, and a movable part positioned ahead of the bonded part on the front side of the valve body sheet and the base member is disposed forward from the bonded part on the valve body sheet, and the inner edge of said base member is positioned, in the direction from the front end of the valve body sheet to the base end thereof, at or less than a ¾ point of the movable part.

13. The compression bag as defined in claim 12, wherein the valve body sheet is not adhered to said frontal sheet or rear sheet in any place other than said bonded part and a side seal as a sidewall of the air passageway, and the base member is not adhered to said frontal sheet or rear sheet in any place other than said side seal.

* * * * *